United States Patent [19]

Westphal

[11] 4,354,784

[45] Oct. 19, 1982

[54] METHOD AND APPARATUS FOR FORMING A NON-SILVER SCORED METAL END

[75] Inventor: Teddy M. Westphal, Glencoe, Mo.

[73] Assignee: Boise Cascade Corporation, Boise, Id.

[21] Appl. No.: 200,595

[22] Filed: Oct. 24, 1980

Related U.S. Application Data

[62] Division of Ser. No. 70,170, Aug. 27, 1979, Pat. No. 4,254,890.

[51] Int. Cl.[3] ..... B21D 51/44

[52] U.S. Cl. ..... 413/12; 413/67

[58] Field of Search ..... 29/DIG. 33; 72/347, 72/348, 349; 220/276, 266, 277, 67; 83/879, 880; 113/15 R, 15 A, 121 C, 1 F, 116 CC, 80 D, 80 DA, 121 B, 120 Q; 413/12, 15, 17, 67, 8, 55

[56] References Cited

U.S. PATENT DOCUMENTS 3,946,683 3/1976 Jordan ..... 113/121 C X 4,122,791 10/1978 Brown ..... 113/121 C

*Primary Examiner*—Mark Rosenbaum

*Attorney, Agent, or Firm*—Laubscher, Philpitt & Laubscher

[57] ABSTRACT

A non-silver scored metal end closure member, and an apparatus and method for forming the same, are disclosed, characterized by the provision of a continuous scoreline between the radius and central panel portions of the end. The scoreline includes, in cross-sectional profile, a horizontal flat bottom wall, and outwardly divergent outer and inner side walls. In the preferred embodiment of the invention, the scoreline is contained in the upper horizontal surface of the metal end, the other side wall of the scoreline being concave and having a radius less than that of the radius portion of the metal end, the bottom wall being tangent to the outer side wall. The inner side wall comprises either a flat surface arranged at an obtuse angle of about 165° relative to the bottom wall, or a concave surface tangent to the bottom wall. In another modification, the inner side wall is concave and tangent to the bottom wall, the radius of the inner side wall being at least as great as that of the outer side wall. In a further embodiment, the outer and inner side walls are flat and are arranged to subtend an angle greater than 90°. The scoreline is formed by a scoring die having an annular downwardly depending projection the cross-sectional profile of which corresponds with that of the scoreline.

3 Claims, 7 Drawing Figures

Fig. 1
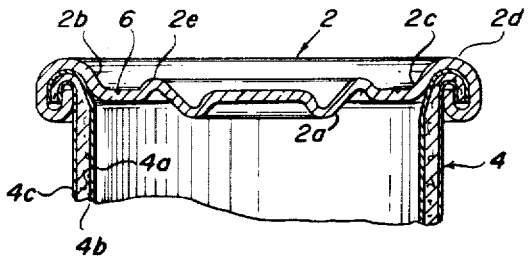
Fig. 2
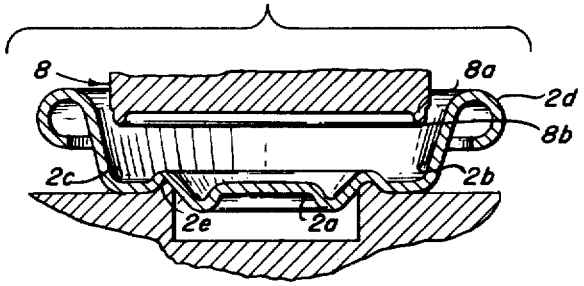
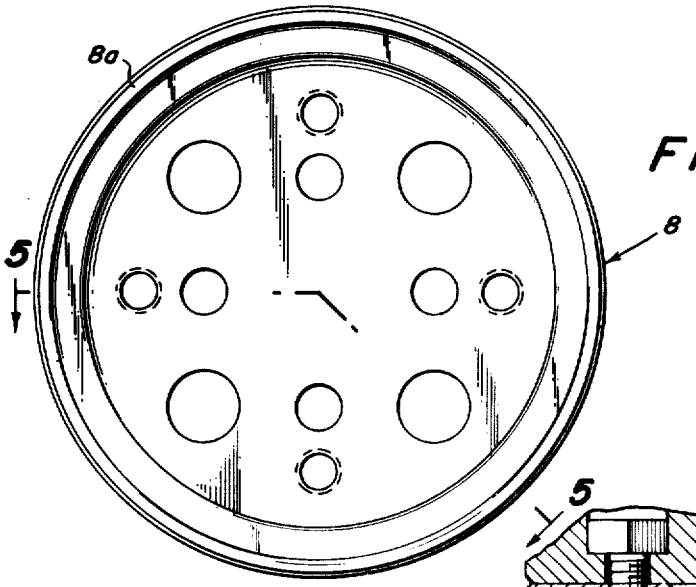
Fig. 4
Fig. 5
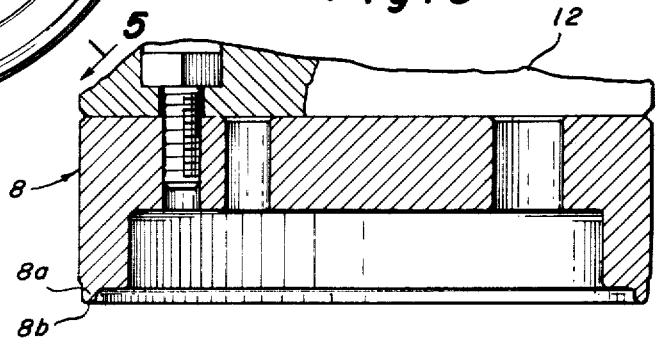

METHOD AND APPARATUS FOR FORMING A NON-SILVER SCORED METAL END

This application is a division of application Ser. No. 70,170 filed Aug. 27, 1979, now U.S. Pat. No. 4,254,890 and is related to the subject matter disclosed in my U.S. Pat. No. 4,216,736, both of which are assigned to the same assignee as the present invention.

BRIEF DESCRIPTION OF THE PRIOR ART

It is well known in the patented prior art to provide a scoreline in the radius portion of a metal end closure member affixed to a composite container for improving the opening operation thereof by means of a mechanical can opener, as evidenced by the Ellerbrock U.S. Pat. No. 3,397,809 (assigned to the same assignee as the present invention). Moreover, in the Brickeen U.S. Pat. No. 4,144,994, during the manufacture of a metal end closure member, the central diaphragm spanning the distance between the flange structure is coined in the same operation forming the flange structure. Such coining forms an annular area of a width greater than a mere narrow line of weakness adjacent the flange structure. The annular area has a width of the order of 0.030 inch and a thickness thereat from 0.0025 inch to 0.0030 inch, much less than the thickness of the closure material which generally varies from 0.0085 inch to 0.010 inch.

It has also been proposed to provide various cross-sectional profiles for the continuous scorelines associated with easy-open containers, the fullopening removable panels of which are provided with pull tab means, as evidenced by the patents to Zundel U.S. Pat. No. 3,875,884, Holk et al No. 3,898,944 and Cookson No. 3,951,084. In the pull-tab type metal end of Jasper No. 3,406,866, a pair of concentrically spaced scorelines are provided one of which constitutes an anti-fracture scoreline, said scorelines each having a profile with a flat bottom wall and outwardly divergent flat inner and outer side walls. Various other types of scoreline profiles have been proposed in the U.S. Pat. to Urmston No. 3,938,455, Jordon No. 3,946,683, Herbst et al No. 3,970,023, Lovell et al No. 4,006,700, Schrecker No. 3,688,718, and Kindel No. 3,701,330, among others.

During the mechanical opening of a metal end closure member with a conventional can opener, it is desirable to reduce to a minimum the formation of undesirable metal slivers. As set forth in the Ellerbrock patent referred to above, in the case of composite containers having a fibrous body wall, it is often difficult to achieve proper gripping of the can opener to the rolled seam between the metal end closure member and the fibrous body wall, and owing to the improper orientation of the can opener means, there is also a further possibility of the formation of the undesirable metal slivers.

SUMMARY OF THE INVENTION

Accordingly, the present invention was developed to provide an improved non-sliver scoreline for metal ends, and to a method and apparatus for forming the same.

According to a primary object of the invention, a metal end closure member is provided the upper or lower surface of which contains between the radius and central panel portions of the end a continuous annular scoreline which includes, in cross-sectional profile, a central flat bottom wall, and outer and inner side walls that diverge outwardly from the bottom wall. In one embodiment of the invention, the scoreline is formed in the upper surface of the end, the scoreline outer wall being concave and having a radius concentric with that of the radius portion of the metal end, the scoreline bottom wall being tangent to the bottom wall. The scoreline inner side wall may be either a flat wall arranged at an obtuse angle of about 165° relative to the bottom wall, or a concave side wall having a radius corresponding generally to that of the outer side wall. In a second embodiment, the inner and outer scoreline side walls are flat and are arranged at an obtuse angle greater than 90° relative to each other.

In accordance with another object of the invention, a method and apparatus are provided for forming a continuous scoreline having the aforementioned cross-sectional profile in the upper or lower surface of a horizontally supported metal end member between the central panel and radius portions thereof. The metal end is subsequently connected by a rolled seam flange connection with the open upper end of a container.

BRIEF DESCRIPTION OF THE DRAWING

Other objects and advantages of the invention will become apparent from a study of the following specification when viewed in the light of the accompanying drawing, in which:

FIG. 1 is a detailed transverse cross-sectional view of a composite container including the non-sliver scored metal end closure member of the present invention;

FIG. 2 is a detailed sectional view illustrating the scoring die that is used to form the non-sliver scoreline of the present invention in the upper surface of a horizontally supported metal end closure blank;

FIG. 4 is a bottom view of the scoring die of FIG. 2;

FIG. 5 is a sectional view taken along line 5—5 of FIG. 4;

DETAILED DESCRIPTION

Figure 3:
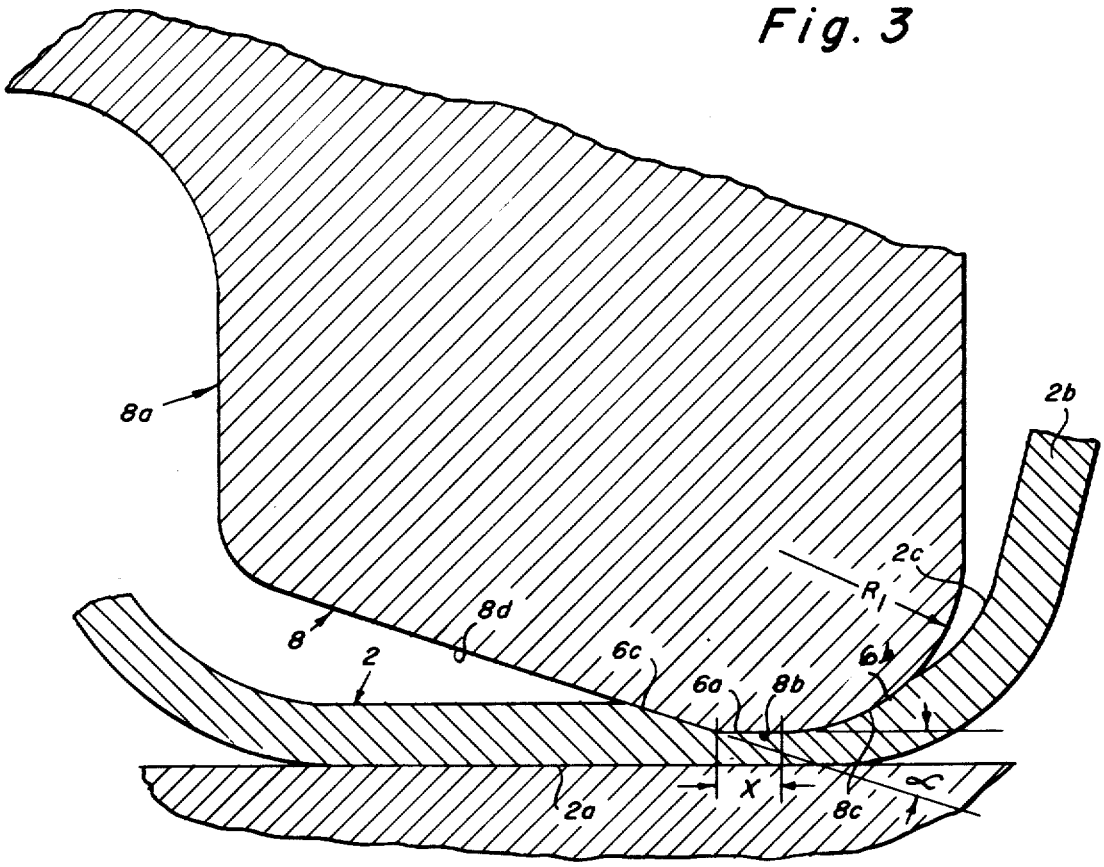
FIG. 3 is an enlarged detailed sectional view illustrating the formation of the scoreline of the present invention in the metal blank of FIG. 2.

Referring first more particularly to FIG. 1, the improved non-sliver scored metal end 2 of the present invention is adapted for connection with the open upper end of a container body wall 4 by a conventional rolled seam connection. More particularly, the body wall 4 is of composite construction including an inner liner layer **4*a* (formed of aluminum foil, for example), a fibrous body wall 4*b* (formed of paperboard, for example), and an outer label layer 4*c* (formed of paper, a paper/foil laminate, or the like). The metal end closure member 2, which may be formed of steel or aluminum, for example, includes a removable central panel portion 2*a*, an annular chuck wall portion 2*b* that is connected with the outer circumferential edge of the central portion 2*a* by a curved radius portion 2*c*, and a radially outwardly extending annular flange portion 2*d* connected with the upper edge of the chuck wall portion. As is known in the art, the central panel portion 2*a* may be provided with at least one annular strengthening rib 2*e*. As will be described in greater detail below, there is formed in the upper surface of the metal end closure member between the radius portion 2c and the central panel portion 2a a continuous annular scoreline 6**.

Referring now to FIG. 2, the aforementioned scoreline 6 is formed in the horizontally supported metal end closure member by means of a vertically displaceable scoring die 8 having a downwardly depending annular projection 8a. As shown in greater detail in FIGS. 3–5, the lower extremity of the scoring die includes at its lower extremity cross-sectional profile a central flat portion 8b, a convex outer side wall surface 8c, and an angularly arranged inner side wall surface 8d. Consequently, the scoreline defined in the upper surface of the metal end closure member 2 between the radius portion 2c and the central panel portion 2a includes a horizontal flat bottom wall 6a, a concave outer side wall 6b, and an angularly arranged flat inner side wall 6c. The scoreline side walls diverge outwardly from the flat bottom wall 6a. Preferably, the radius R1 of the outer side wall is less than that of the radius portion 2c of the metal end closure member, the origin of radius R1 being adjacent a vertical line passing through the center of the radius of the radius portion 2c of the metal end.

As shown in FIGS. 4 and 5, the scoring die 8 is of conventional construction and is bolted to the vertically displaceable press member 12.

For metal end closure members having a nominal diameter of 4 inches, the radial dimension X of the scoreline flat bottom wall 6a is from about 0.005 inches to about 0.020 inches, and the radius R1 of the scoreline outer wall is about 0.025 inches. The scoreline inner side wall 6c is arranged at an obtuse angle (i.e., the supplement of angle $\alpha$) of about 165° relative to the scoreline bottom wall 6a. Owing to the scoreline configuration with side walls diverging outwardly from the horizontal flat bottom wall 6a, and furthermore, since the scoreline 6 is between the central panel portion 2a and the radius portion 2c of the metal end closure member, when the container is opened mechanically by means of a conventional can opener, the formation of metal slivers from the metal end closure member is eliminated.

It is apparent that die means similar to those of FIG. 2 could be used to form a scoreline in the lower surface of the end between the radius and removable central panel portions.

Figure 6:
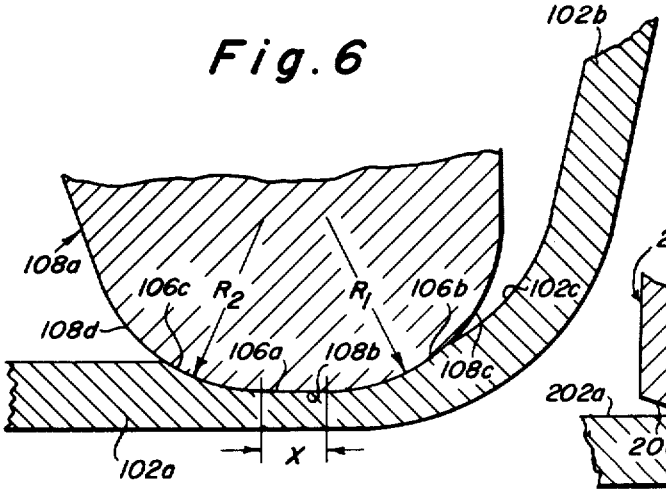
FIG. 6 is a detailed sectional view of a second embodiment of the scoreline and scoring die apparatus of FIG. 3.

Referring now to the modification of FIG. 6, the continuous circular scoreline formed in the upper surface of the metal end between the central panel portion 102a and the radius portion 102c includes a horizontal flat bottom wall 106a, a concave outer side wall 106b, and a concave inner side wall 106c. Thus, in this modification, the scoring die 108a includes in cross-sectional profile a central flat portion 108b, a convex outer side wall portion 108c, and a convex inner side wall portion 108d, the horizontal flat portion 108b being tangent to both convex surface portions 108c and 108d, respectively. Thus, the radius of curvature R2 is arranged on a vertical line passing through the adjacent edge of the flat portion 106a, said radius R2 corresponding generally with the radius R1 of the convex outer side wall portion 106b. The center of the radius R1 of the outer side wall portion 106b is adjacent the vertical line passing through the radius of the radius portion 102c of the metal end.

Figure 7:
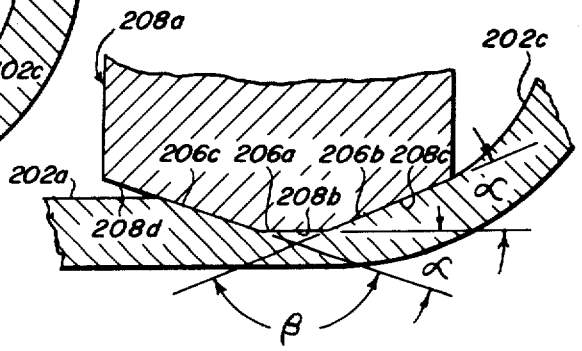
FIG. 7 is a detailed sectional view of a third embodiment of the invention of FIG. 3.

In the embodiment of FIG. 7, the scoreline formed in the upper surface of the metal end between the central panel portion 202a and the radius portion 202c includes a flat horizontal bottom wall 206a, a flat outwardly divergent outer side wall 206b, and a flat divergent inner side wall 206c. In this embodiment, the scoreline inner and outer side walls 206b and 206c are inclined at an obtuse angle (i.e., the supplement of the acute angle $\alpha$) with the bottom wall 206a and subtend an angle $\beta$ that is an obtuse angle greater than 90° The scoring die projection 208a includes in cross-sectional profile corresponding central flat portion 208b, a flat outer portion 208c, and a flat inner side wall portion 208d. Owing to the divergency of the scoreline side walls at an obtuse angle greater than 90°, the production of slivers during the can opening operation by mechanical can opener means is avoided.

Although the different scoreline embodiments have been illustrated as being contained in the upper horizontal surface of the metal end closure members, it is apparent, that they could be formed in the lower surfaces of the metal ends. Furthermore, while illustrated metal ends are of circular configuration, it is apparent that ends of elliptical or other configuration could be provided with the novel scoreline construction of the present invention.

It is the unique profile of the scoreline of the present invention that affords the ability to coin the countersink area of the can end to the thin metal in this area to provide a weakened member that will fracture easier than non-coined parent metal when a mechanical can opener is used to sever the center portion of the can end from the container. Because of the profile of the coined area, it eliminates the potential of metal slivers generated by the blade of the can opener as it severs the metal. The scoreline profile of the present invention does not have the narrow score residual metal normally defined by the scorelines of the prior art, which is the portion of these scores that would be severed and rubbed or shaved off by the can opener blade, forming metal slivers. It is the broad open score profile of the present invention that conforms to the profile of the can end and does not have a score groove as disclosed in the prior art, and consequently the score may be opened by a mechanical can opener in a manner to reduce the generation of slivers.

While in accordance with the provisions of the Patent Statutes the preferred forms and embodiments of the invention have been illustrated and described, it will be apparent to those skilled in the art that various changes and modifications may be made without deviating from the inventive concept described above.

What is claimed is:

1. The method of forming a continuous annular scoreline (6) in the upper surface of a horizontally supported end closure member (2) having a central panel portion (2a), a chuck wall portion (2b), and a radius portion (2c) connecting said central panel and chuck wall portions, which comprises the steps of (a) arranging opposite the closure member a scoring die (8) having a single downwardly depending annular projection (8a) for forming an annular scoreline (6) between the radius and central panel portions of the end, thereby to define a removable portion within the closure member central panel portion, said projection including in cross-sectional profile (1) a central horizontal flat surface portion (8b) for forming the bottom wall of the scoreline (2) a convex outer wall surface portion (8c) diverging outwardly from one end of said bottom wall for forming the outer side wall of the scoreline, said central flat surface portion being tangent to the surface of said outer wall portion; and (3) a flat inner wall surface portion (*8d*) diverging outwardly from the other end of said bottom wall for forming the inner side wall of the scoreline, said inner wall surface portion being angularly arranged at an obtuse angle relative to said central flat surface portion; and (b) pressing said scoring die vertically into the upper surface of the closure member while horizontally supporting the lower surface of said closure member opposite said score die annular projection to form the scoreline between the central panel and radius portions of the member, whereby when the metal end is opened mechanically by a can opener, the formation of metal slivers is minimized.

2. The method as defined in claim 1, and further including the step of connecting the flange portion of the end closure member to the open end of a body wall member by a rolled seam connection, said body wall member including at least one fibrous layer.

3. The method as defined in claim 1, wherein the radius of said die outer wall surface portion is less than that of the radius portion of the end closure member, the center of the radius of said outer wall surface portion being adjacent the vertical line which also contains the center of the radius of the end closure member radius portion.

* * * * *